United States Patent [19]

Hurst et al.

[11] 4,044,563

[45] Aug. 30, 1977

[54] SUBSIDENCE CONTROL

[75] Inventors: Robert E. Hurst; Charles L. Lunsford, both of Tulsa, Okla.

[73] Assignee: The Dow Chemical Company, Midland, Mich.

[21] Appl. No.: 326,611

[22] Filed: Jan. 26, 1973

[51] Int. Cl.[2] ..... E21F 15/08

[52] U.S. Cl. ..... 61/35; 299/11

[58] Field of Search ..... 299/11; 61/35, 36 R; 175/72; 302/66; 169/2 R, 1 R

[56] References Cited

U.S. PATENT DOCUMENTS

| | | | |
|---|---|---|---|
| 2,815,079 | 12/1957 | Goins, Jr. et al. | 166/294 |
| 3,421,587 | 1/1969 | Meauilon et al. | 299/11 |
| 3,440,824 | 4/1969 | Doolin | 61/35 |
| 3,459,003 | 8/1969 | O'Neal | 299/11 |
| 3,500,934 | 3/1970 | Magnuson | 61/35 |
| 3,508,407 | 4/1970 | Booth | 61/35 |
| 3,684,022 | 8/1972 | Peterson | 169/2 R |
| 3,817,039 | 6/1974 | Stewart et al. | 61/35 |

*Primary Examiner*—Paul R. Gilliam
*Assistant Examiner*—Alex Grosz
*Attorney, Agent, or Firm*—B. M. Kanuch; G. H. Korfhage

[57] ABSTRACT

A method is provided for filling a subterranean void, e.g. a mined out cavity such as a tunnel. An aqueous suspension of solid particles the mass of which when at rest has a permeability of about 40 darcies, preferably less than 20 darcies, is injected into the void to effect complete filling.

4 Claims, 2 Drawing Figures

SUBSIDENCE CONTROL

BACKGROUND OF THE INVENTION

The problem of filling subterranean voids to prevent their collapse and resultant surface subsidence has received acute attention recently, e.g. see the report of the United States Bureau of Mines entitled "Investigation of Subsidence in Rock Springs, Sweet Water Country, Wyoming" by Donner and Whaite.

Several methods have been developed in an attempt to fill mine viods. These methods are generally broken down into two classes. One is called controlled back filling. In this method filler material is carried into the mine void via the tunnels and passages used originally to withdraw mined ores. This method can only be employed where the underground void is accessible to workmen, which in many instances is impossible or at least highly impractical because of cave-ins, flooding and the like.

Blind flushing is the second general method employed. Several techniques of blind flushing have been proposed. The most common method has been to drill an injection hole from the surface of the ground to connect with the void and then to sluice a slurry of particulate material into the void by gravity flow. A conical shaped bed of material is emplaced directly under the borehole and for a very limited lateral distance therefrom. The amount of surface area which gains support depends on the natural angle of repose of the material in air or water, the size of the void, and the depth of the bed. Various materials have been employed in these sluicing methods, e.g. sand, gravel and fly ash. A variation of this method of filling a void is disclosed in U.S. Pat. No. 1,404,112.

U.S. Pat. No. 2,710,332 shows that a void may be filled by injecting solids, e.g. fly ash, in gas suspension. Further refinements of this techinque are disclosed in U.S. Pat. Nos. 3,421,587 and 3,500,934, wherein fly ash or another equivalent very fine particulate materials are blown into the void. The particulate material is very fine, normally of a size such that 90% will pass a 50 mesh screen and 75% will pass a 325 mesh screen.

Another technique for emplacing a particulate material is disclosed in U.S. Pat. No. 3,440,824. In this method a slurry of solid material and water is pumped downwardly through a conduit inserted in a borehole and the slurry is physically directed towards a second borehole by means of a variable direction nozzle attached to the lower end of the conduit and extending into the cavity. Excess slurrying liquid, e.g. water, is pumped outwardly through the second borehole to create a current between the two boreholes which it is alleged aids in distributing the solid material in the void. The present invention would be useful in the method disclosed in U.S. Pat. No. 3,440,824 to assist in distributing the solid material between the first borehole and the second borehole.

The disposal of waste spent shale is taubht by U.S. Pat. No. 3,459,003. Therein a slurry composed of a major part of the shale and water is pumped into the void. A cement formed from the remaining shale is then pumped into the void — to fill "at least a portion of the void therein." The shale particles used are to be within the size range 5 microns to 0.5 inch; larger waste particles are crushed to this size.

The above-described methods generally represent the known techniques which are employed in an atempt to prevent subsidence caused by underground cavities and voids. All of these methods, however, suffer from some disadvantage. First, the radial distance around the borehole which can be essentially completely filled is relatively limited. Secondly, it is usually difficult to substantially fill the void to the ceiling. Thirdly, many boreholes must be provided when the void to be filled extends over a great distance. This latter disadvantage is particularly troublesome when the void is located beneath a populated area since structures, streets and the like prevent the drilling of a necessary number of boreholes. For example, it has been reported in the Bureau of Mines report, cited previously, that in Rock Springs, Wyo. if a blind sluicing method was employed as many as 3000 boreholes would be required (as many as 75 in a single square block area) to treat 200 acres of land. Even with this many boreholes the voids cannot be completely filled and support is provided only under the streets, alleys and other areas of public access. Only a very limited amount of support for structures. e.g. dwellings and industrial plants can be provided.

A common cause of these disadvantages is the inability to distribute the filler solids in the void at sufficient distance from the input injection shaft. It has been discovered that this is partially caused by absorption of the liquid in which the filler solids are suspended by the solids which are deposited near the exit of the injection shaft. A plug or bridge will form close to the entry point, causing the liquid to flow through the deposit rather than over it. Flow over the deposit is necessary to transport the suspended solids to the extremity of the deposit. Here the solids drop out and extend the deposit as the liquid spreads over the surface of the deposit and the flow rate decreases.

The use of a particular size distribution of particles has been suggested to plug pores and to form thin filter cakes on the internal surfaces of well shafts. U.S. Pat. No. 2,815,079 teaches the use of pre-sized hard granular particles to seal the plug where mud filtercakes are formed. This patent recommends that a certain maximum particle size should be employed and in addition that certain smaller sizes should be employed in specific percentages.

The approach of U.S. Pat. No. 3,042,608 is to use resinoids to seal openings. Emphasis is placed on the advantageous properties of resinous substances for pore plugging purposes. A recommended size distribution is suggested as a corollary consideration once the choice of a resinoid has been made.

The problem presented in filling mined out voids is almost the opposite of that solved by the two above inventions. When filling mined out voids the particles must be held in suspension until they flow sufficiently far from the input point. The cited references must plug pores very close to the input point — the solid may not reamin suspended for very long, or else the plugging of the pores will not occur. The present invention concerns the discovery that mined out voids can be completely filled over large radial distances by employing a fill material having a certain permeability.

SUMMARY OF THE INVENTION

In the practice of the present invention an aqueous suspension of solid particles is injected into a void to be filled at a rate of injection sufficient to propel the particles a distance from the injection location. A size range of solids is employed to form a mound having a permeability of less than about 40 darcies, preferably less than about 20 darcies, relative to the carrier fluid. This reduction in permeability allows the aqueous suspension of solids to propagate further into the void because less of the suspending liquid is absorbed by the solids already deposited. The result is that filler solids may now be carried further into the subterranean void.

DETAILED DESCRIPTION OF THE INVENTION

It has been discovered that a subsurface void can be substantially completely filled to the ceiling thereof with a particulate material for an extensive radial distance surrounding a single injection conduit. This radial distance can vary anywhere from 100 to more than 1000 feet from the injection conduit. Moreover, obstructions such as remaining pillars and cave-ins will not prevent or otherwise affect the filling of the void. The areas of the void located behind pillars (not in line of sight from the injection borehole) are readily filled by practicing the principles of the present invention. Voids filled with water can be beneficially treated by the practice of this invention; however the most effective filling is accomplished when the void treated by the present method is substantially free of water.

It has been discovered that minimization of the permeability of the deposited solids minimizes the extent to which the carrier fluid is absorbed, and therefore maximizes the radial distances to which the suspended solids may be carried. Providing an appropriate size distribution of the solid filler material is found to be one way to reduce the permeability of the deposited solids not only at the input of the injection system but also across the entire surface of the deposit.

Figure 1:
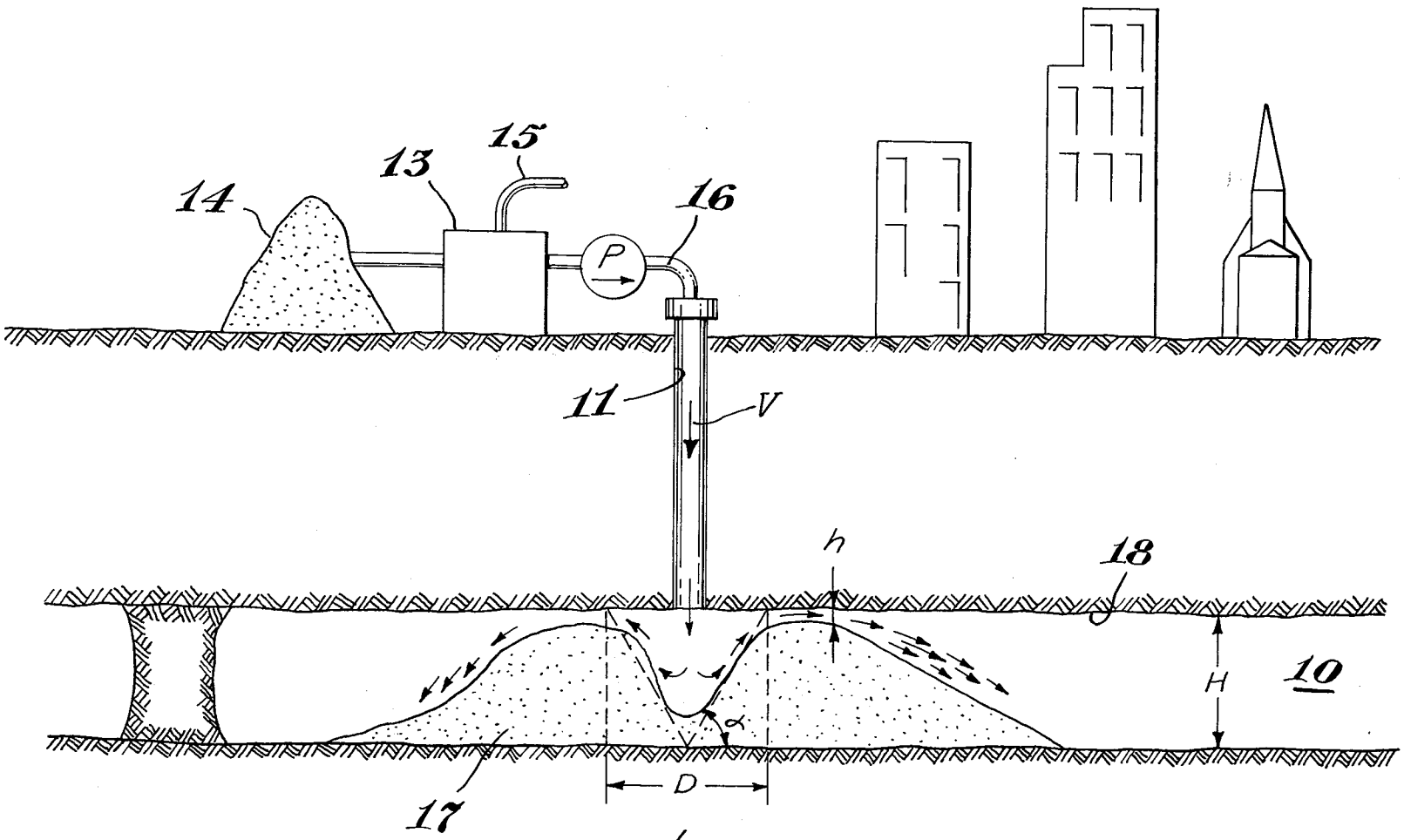
FIG. 1 illustrates one embodiment of filling an underground void employing the principles of the present invention wherein the suspension is injected through a substantially vertical borehole into a mined out void.

It is preferred that a closed, pressurized injection system be employed to conduct the suspension of filler solids into the void. An example of this embodiment of the present invention is shown in FIG. 1. It is desired to fill the mined-out void 10 of height *h* substantially to the ceiling thereof with a particulate material, e.g. sand. An injection conduit 11 (e.g. ranging in size from about 10 to 20 inches in diameter) is provided, e.g. by drilling a cylindrical shaft, to connect the void 10 with the working surface 12, in this instance the surface of the ground. The borehole is also normally cased with inner pipe 11*a* (e.g. ranging in size from about 8 to 14 inches in diameter). The size of the injection conduit 11 is limited only by the equipment which is available to mix and inject the suspension. The system is connected in such a manner that the suspension is injected through a closed pressurized system. An aqueous suspension of a particulate material is injected (e.g. by pumping) through the conduit 11 and into the void 10. The mixing, supply sources of particulate material and water, and injection equipment are schematically shown in the Figure as 13, 14, 15 and 16, respectively. As the suspension is injected down the conduit 11, a donut-shape mound 17 of particulate material is formed on the floor of the void. As the mound increase in height the distance (*h*) (across cross-sectional area) between the rim of the mound 17 and the ceiling 18 of the cavity decreases causing the linear velocity of the suspension to increase so that particulate material will be carried over the rim of the mound. Thereafter the linear velocity of the suspension will drop, causing a further settling of material with a subsequent growth in the radial size and height of the mound. The mound progresses out in a random fashion radially from the injection conduit 11.

The suspension is injected for any desired length of time, or until a certain desired area of the void is filled with the particulate material, or until the distance from the borehole is such that there is insufficient available hydraulic horsepower to extend the mound further.

A particularly useful embodiment of the invention is obtained when the filling fluid is injected into the void at a certain critical minimum rate. This rate can be calculated for any fill material by employing the following formula: (1) $V - xd\pi Dv$, wherein $V =$ the minimum rate of injection in cubic feet per minute, $x$ is a number of 3 or greater, $d$ is the diameter in feet of the largest solid particles in said suspension, $D$ is the diameter, in feet, of the base of a cone formed by said particles in said carrier liquid when motionless, said cone having a height equal to the height to which said void is to be filled, and $v$ is the minimum linear velocity of said suspension in feet per minute. "Minimum linear velocity" is the minimum velocity at which suspension of particles must be conducted through a generally horizontally displaced conduit so that there occurs no substantial deposition of particles from the suspension onto the lower portion of the conduit. For any given suspension, i.e., a liquid medium in which solid particles are suspended, "minimum linear velocity" can be determined either experimentally or by employing formulae developed by investigators in the art of hydraulic flow.

Various methods may be employed to inject the particulate solids into the mined out void. For example, the method and apparatus taught in U.S. Pat. No. 3,440,824 and described in the present Background of the Invention can be employed; the teaching of this patent is herewith incorporated by reference into the present application as one embodiment thereof. Also, the slurry could be pumped into the void and allowed to build up a deposit in a random manner. Additionally, the slurry can be pumped into the void by the use of only a single conduit.

The particulate material can be any solid having a density greater than the carrying liquid. For example fly ash, sand, crushed slag, limestone, gravel or other similar material can be used. When the method is employed to improve the environmental conditions located at the surface, particulated tailings, trash and other wastes can be properly particulated and used as the fill material.

The carrier liquid may be any liquid which will suspend the particulate material chosen and which is injectable under pressure into the void. Suitable fluids include, e.g., water and brines. A useful technique of employing the present invention involves removing the water often found in voids and utilizing this water as the carrier liquid.

The present invention involves injecting, or otherwise introducing, a solid suspension chosen so that the mound of fill formed has low permeability. Accordingly, the particulate solid is chosen so that its permeability to the carrier liquid is less than 40 darcies, and preferably less than 20 darcies relative to the carrier fluid. The permeability may be, and was in Examples I–V, determined by the following procedure. A cylindrical tube of 12 in. length and 0.5 in. inside diameter is filled with the particulate solids the permeability of which is to be determined. After settling the solids by use of a mechanical vibrator, the ends of the tube are capped and water is conducted through the tube at controlled pressure. The flow rate is measured, and Darcy's equation for linear flow is applied to the data to calculate permeability:

$$K = \frac{Q\mu L}{AP} \quad (2)$$

where $K$ = permeability in darcies;
$Q$ = flow rate
$\mu$ = viscosity
$L$ = length of flow column
$A$ = cross sectional area
$P$ = differential pressure through the column One way to obtain particulate materials having the desired permeability is to crush available particulate matter to a uniform size distribution across a range of sizes extending, for example, from a diameter of about one inch down to a mesh size of about 100 (U. S. Standard Sieve Series) or more. Preferably this size distribution is uniform across a band of mesh sizes from about 2 to about 100 mesh, preferably with 75% of the particles within the range from 10 to about 60 mesh. Examples I–V demonstrate the effect of this procedure.

In addition, a particulate solid of low permeability can be obtained by blending quantities of other particulate materials, e.g. polymers, of known sizes where each quantity of material is itself lacking a fairly uniform and fairly small size distribution, in the proper proportions to yield a product having a fairly uniform distribution of all sizes but with the majority being in the samller ranges. Similarly, undesirably large amounts of any size range may be sieved out and discarded. The larger sizes of sieved out material may be crushed and mixed back into the mass to be injected.

The carrying liquid is preferably an aqueous liquid, e.g. locally available water or brines being preferred. The concentration of particulate solids in the suspension liquid is not critical to the practice of the present invention, although the rate at which the void can be filled at a certain injection rate is influenced by the concentration of the solids. Generally a concentration of about 0.5 to about 10.0 pounds of particulate solids per gallon of carrier liquid can be employed. For practical handling, a solid to liquid ratio by weight in the range of 1:8 to 5:8 is desirable.

In another embodiment of the present invention at one or more points during the filling operation a filtercake is formed over the deposited solids. A filtercake is a relatively thin layer of substantially impermeable solids. The filtercake substantially covers the deposited solids and minimizes the fluid loss therethrough. This embodiment can be employed with or without the particular size distribution hereinbefore described. One technique of forming a filtercake involves periodically injecting a slug of filtercake forming solids as the injection of filler solids progresses. Another technique involves stopping the injection of filler solids and then injecting the slug of filtercake forming solids. Such a slug is typically first injected when the ring of filler solids formed at the bottom of the injection shaft extends almost to the ceiling of the void and so far outwardly that the linear velocity of the suspension fluid is detrimentally reduced, i.e., below the "minimum linear velocity," and filling to the ceiling would result.

The point in time at which the filtercake material should be injected is calculable from the permeability of the deposit, the height of the void, and the injection rate. The filtercake should be injected before the rate of fluid loss through the deposited solids exceeds about 50% of the fluid injection rate. Preferably the filtercake is injected when the fluid loss rate reached 5% of the fluid injection rate.

It has been determined that the point in time at which the fluid loss rate reaches a given percentage of the fluid injection rate is a function of the permeability of the deposit, the height of the void being filled, and the injection rate.

That point is estimable by use of the formula $$t = \frac{9\pi h}{sV}\left[{}_e\left(\frac{6.13h^2k}{sV}\right)_{-1}\right] \quad (3)$$

wherein $t$ = the period of time during which solids have been injected into the void in days;
$h$ = the height of the void in feet;
$k$ = the permeability of the solids deposited in the void in darcies;
$s$ = the ratio of fluid loss rate to fluid injection rate at which the injection step is desired to be halted; and
$V$ = the injection rate of filler solids in barrels per day.

Thus the preferred time at which to stop the injection step, i.e., when the fluid loss rate attains 5% of the injection rate, is estimated to be $$t = \frac{180\pi h}{V}\left[{}_e\left(\frac{122.6h^2k}{V}\right)_{-1}\right]. \quad (4)$$

The amount of filtercake solid to be injected should be sufficient to cover substantially all of the exposed surface of the deposited solids. The depth of the filtercake will vary across the surface, but should average at least about ½ inch in depth, preferably 2 inches. Assuming a 2 inch depth, the amount of filtercake solid to be injected may be estimated by use of the formula $$V' = 0.16\left(\frac{Vt}{h} + 2\pi h\sqrt{\frac{Vt}{\pi h} + 9'}\right) \quad (5)$$

wherein $V'$ = the amount of fillercake material to be injected in cubic feet; $V$ = the injection rate of filter solids in barrels per day; $h$ = the height of the void in feet; and $t$ = the total amount of time during which filler solids have been injected in days.

The filtercake solid may be any of those materials which were previously noted as usable as filler solids; however it is desired that the permeability of the particular distribution of the particular solid which is injected to form the filtercake should have as low a permeability to the carrier fluid as possible, e.g. less than the permeability of the deposit of filler solids, preferably less than about 5 darcies.

In filling a certain mined-out void by injection of suspended solid material, substantial losses of carrier fluid were experienced. By reducing the permeability of the solid particles to 40 darcies in accordance with the principle of the present invention, the fluid loss can be held to 11.4%. Reduction to 5.7% fluid loss is attainable if the permeability is held to 20 darcies or less, allowing substantial fluid and time savings compared to presently utilized methods of void filling.

The following examples show the effect of range and uniformity of size distribution on permeability.

EXAMPLE I

Material was taken from a mining refuse bank and put through a series of mesh screens. The size distribution of the particles was 64% in mesh sizes 3–10 and 36% in sizes 10–20. The permeability of this material was 1200 darcies — as measured by the hereinbefore described technique.

EXAMPLE II

River sand of readily pumpable size was screened and found to have a mesh size distribution as follows:

| Mesh | Percentage Composition |
|---|---|
| 6–10 | 7 |
| 10–12 | 27 |
| 12–16 | 41 |
| 16–20 | 22 |
| 20+ | 3 |

The permeability was measured by the above technique to be 220 darcies.

EXAMPLE III

In accordance with a suggested embodiment of the present invention, an attempt to achieve permeability lower than 40 darcies was made by hammer crushing river sand particles for a short period of time. The following size distribution evidenced a permeability of 56 darcies:

| Mesh | Percentage Composition |
|---|---|
| 6–10 | 5 |
| 10–12 | 21 |
| 12–16 | 30 |
| 16–20 | 16 |
| 20–40 | 11 |
| 40–60 | 7 |
| 60–100 | 4 |
| 100+ | 6 |

EXAMPLE IV

Another quantity of sand was crushed for a longer period, and the goal was achieved. A permeability of 11 darcies was attained, well below the 40 darcy standard and even below the 20 darcy preferred level.

| Mesh | Percentage Composition |
|---|---|
| 6–10 | 1 |
| 10–12 | 9 |
| 12–16 | 11 |
| 16–20 | 5 |
| 20–40 | 33 |
| 40–60 | 14 |
| 60–100 | 11 |
| 100+ | 16 |

EXAMPLE V

A still more uniform size distribution of river sand was achieved in this example; the permeability was measured to be only 10 darcies.

| Mesh | Percentage Composition |
|---|---|
| 2–6 | 8 |
| 6–10 | 7 |
| 10–12 | 11 |
| 12–16 | 17 |
| 16–20 | 10 |
| 20–40 | 23 |
| 40–60 | 10 |
| 60–100 | 8 |
| 100+ | 6 |

Figure 2:
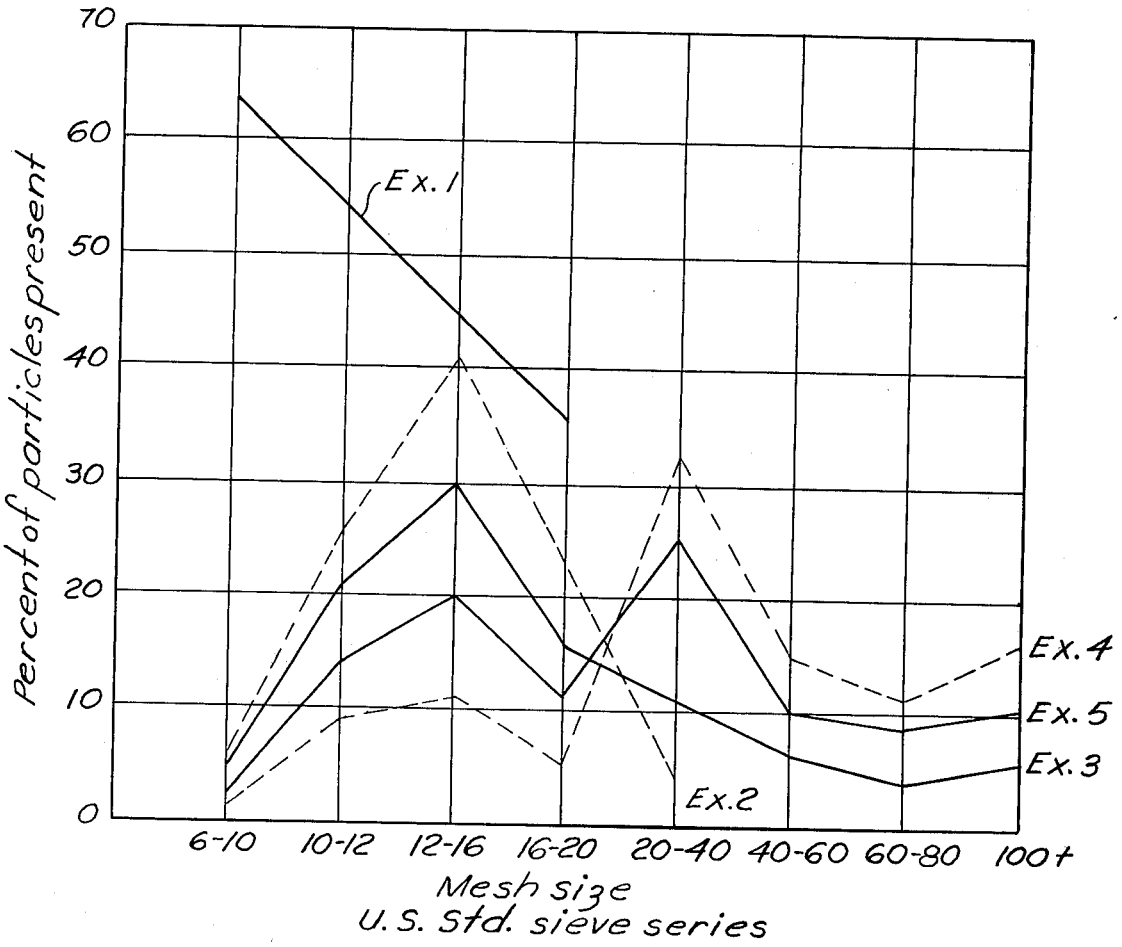
FIG. 2 graphically illustrates the data obtained during the tests described as Examples I–V.

The data from Examples I–V are illustrated in FIG. 2.

By employing fill material having a lower permeability, voids can be filled to a greater distance from a single injection well. Although the examples show one method of reducing permeability of the fill material, other methods for reducing permeability can be employed either alone or in conjunction with size distribution.

For example, a quantity of highly viscous or gelled water, or brine where such might more conveniently available as the carrying agent for the backfill material, can be used to cover and essentially seal a deposit of permeable fill material to reduce fluid loss therethrough. The gelled water preferably also has particulate material added to it since the suspended solids improve the shutoff properties of the gell while at the same time adding to the backfill deposit. As an example, a gel having a viscosity in the range of about 20 to about 100 centipoise (cps) at the time of injection is premixed and allowed to develop the viscosity prior to injection. The use of a slug of gel with a viscosity of 100 cps will, in accordance with Darcy's equation, decrease the fluid loss rate by 100-fold over that of water itself. The gel may be formulated to thicken additionally after pumping, to give enhanced fluid loss control without unduly sacrificing pumpability and flowability over the initially permeable deposit; a too viscous gel will not be distributed over the deposit to produce efficient coverage.

A second and preferable manner of treatment is to employ a delayed action gelling material. In this fashion, the premixing stage is eliminated, the gelling agent and water or brine being mixed continuously as the injection of slurry of fackfill is carried out. During the mixing, injection and initial flow stage, the water is not thickened, and essentially no additional power to pump is required, nor is flowability sacrificed. Once the gelling action starts, the gel forms rapidly and soon reaches a nonflowable stage; the viscosity becomes nearly infinitely high and the permeability to fluid leak-off accordingly nearly zero. Various gelling agents and blends thereof, with or without inhibitors and catalysts to gellation, are known and suitable for this use. Little or no fluid is lost to the permeable deposit through the viscous coating or blanket, and all the injected fluid is available for maintaining the minimum linear velocity.

Agents for gelling the water or brine include the various water responsive natural and synthetic gums and polymers. Among the natural gums are guar, locust bean, tragacanth, polysaccharides, and acacia. The synthetic gums or polymers include acrylamides and modified or solubilized celluloses.

What is claimed is:

1. In a method of filling a subterranean void by injecting under pressure a carrier liquid, in which solid particles are suspended said particles consisting of a material which in a deposited form is permeable to the flow of said carrier liquid, into said void to form a deposit of solid particles within said void, the improvement which comprises: emplacing a filtercake consisting of a second layer of solids which is substantially impermeable to said carrier liquid on the exposed surface of the deposit then present to render said surface less permeable to said carrier liquid and then continuing said injection of said suspension of solid particles thereby to extend the deposit of said particles through said void.

2. The method of claim 1 wherein the filter cake is formed after first discontinuing the injection of the liquid in which solid particles are suspended.

3. The method of claim 1 wherein the subterranean void is initially substantially free of water.

4. The method of claim 1 wherein the injection of solid particles is effected by a blind flushing technique comprising drilling at least two spaced boreholes from the surface through the roof of the mine cavity to be filled; providing a conduit having a variable direction orifice secured thereto and dimensioned to be capable of insertion through one of said boreholes; inserting said conduit and variable direction orifice into said one of said boreholes; mixing a slurry of solid material and water; introducing said slurry into said mine cavity through said conduit, adjusting said variable direction orifice so as to direct the flow of slurry material toward another borehole; and pumping excess water in said mine cavity to the surface through said another borehole.

* * * * *